US006877289B2

(12) United States Patent
Yao et al.

(10) Patent No.: US 6,877,289 B2
(45) Date of Patent: Apr. 12, 2005

(54) PANEL DOOR

(75) Inventors: Philip Yao, San Juan (PH); Sherwin Yao, San Juan (PH); Jeremy Sy, San Juan (PH)

(73) Assignee: GPI International, Inc., Georgetown (KY)

( * ) Notice: Subject to any disclaimer, the term of this patent is extended or adjusted under 35 U.S.C. 154(b) by 0 days.

(21) Appl. No.: 10/384,445

(22) Filed: Mar. 6, 2003

(65) Prior Publication Data

US 2004/0074207 A1 Apr. 22, 2004

Related U.S. Application Data

(60) Provisional application No. 60/362,352, filed on Mar. 6, 2002.

(51) Int. Cl.[7] ..... E06B 3/72; E06B 3/74

(52) U.S. Cl. ..... 52/456; 52/784.1; 52/455

(58) Field of Search ..... 52/456, 455, 784.1

(56) References Cited

U.S. PATENT DOCUMENTS

| | | | | |
|---|---|---|---|---|
| 432,504 | A | | 7/1890 | Amsden |
| 435,313 | A | * | 8/1890 | Lohse |
| 440,245 | A | * | 11/1890 | Benedict |
| 460,323 | A | | 9/1891 | Merriman |
| 579,696 | A | * | 3/1897 | Carter |
| 619,676 | A | * | 2/1899 | Cronin |
| 632,700 | A | * | 9/1899 | Cronin |
| 660,223 | A | * | 10/1900 | Rapp |
| 682,322 | A | * | 9/1901 | Cronin |
| 825,777 | A | * | 7/1906 | Tonnsen |
| 826,549 | A | * | 7/1906 | Diver |
| 1,104,868 | A | | 7/1914 | Bolin |
| 1,540,932 | A | * | 6/1925 | Dodge |
| 2,791,809 | A | * | 5/1957 | Lincoln |
| 3,305,992 | A | * | 2/1967 | Steed |
| 3,512,304 | A | * | 5/1970 | Meuret |
| 4,702,054 | A | | 10/1987 | Turner |
| 4,825,615 | A | * | 5/1989 | Turner |
| 5,074,092 | A | | 12/1991 | Norlander |
| 5,417,024 | A | | 5/1995 | San Paolo |
| 5,469,903 | A | | 11/1995 | Stanley |
| 5,771,656 | A | * | 6/1998 | Amoretti |

FOREIGN PATENT DOCUMENTS

| | | | | |
|---|---|---|---|---|
| GB | 2 099 488 | A | * 12/1982 | ..... E06B/3/72 |

* cited by examiner

*Primary Examiner*—Robert Canfield
(74) *Attorney, Agent, or Firm*—Kolisch Hartwell, P.C.

(57) ABSTRACT

A panel door including a framework configured to form a support structure for the panel door. The panel door further including a set of surface covers configured to overlay the framework and be secured thereto to form both a set of stiles and a set of rails for the panel door, wherein the set of stiles includes at least one intermediate stile. The door includes a set of open spaces bounded by the set of rails and the set of stiles. The door further includes a set of panels secured in the set of open spaces between the stiles and rails.

8 Claims, 2 Drawing Sheets

PANEL DOOR

CROSS-REFERENCE TO RELATED APPLICATIONS

This application is based upon and claims priority under 35 U.S.C. §119(e) to the following U.S. provisional patent application, which is incorporated herein by reference in its entirety for all purposes: Ser. No. 60/362,352, entitled "Panel Door," filed Mar. 6, 2002.

FIELD OF THE INVENTION

The present invention relates generally to doors. More specifically, the present invention relates to a panel door apparatus and method of making the same.

BACKGROUND OF THE INVENTION

Decorative panel doors are popular because of their aesthetic appeal. A conventional panel door includes stiles extending vertically and rails extending horizontally. The rectangular spaces bounded by the stiles and rails are filled with panels. Typically, the panels are made of wood and have tapered edges configured to fit within grooves in the surrounding stiles and rails. Alternatively, the panels may include surface ornamentation or be made of a decorative material such as glass. Conventional panel doors may be made of decorative hardwoods such as oak, mahogany, cherry, etc.

Unfortunately, these conventional panel doors tend to suffer from stability problems. Over time the stiles and rails can sag, warp, split, and separate from the panels. Additionally, conventional panel doors made of decorative hardwoods are very heavy making them difficult to hang. Heavy doors require more substantial hardware and are more prone to misalignment during the hanging process. It would be desirable to provide a decorative panel door that is both stable and lightweight.

SUMMARY OF THE INVENTION

A panel door including a framework configured to form a support structure for the panel door. The panel door further including a set of surface covers configured to overlay the framework and be secured thereto to form both a set of stiles and a set of rails for the panel door, wherein the set of stiles includes at least one intermediate stile. The door includes a set of open spaces bounded by the set of rails and the set of stiles. The door further includes a set of panels secured in the set of open spaces between the stiles and rails.

DETAILED DESCRIPTION OF THE INVENTION

Figure 1:
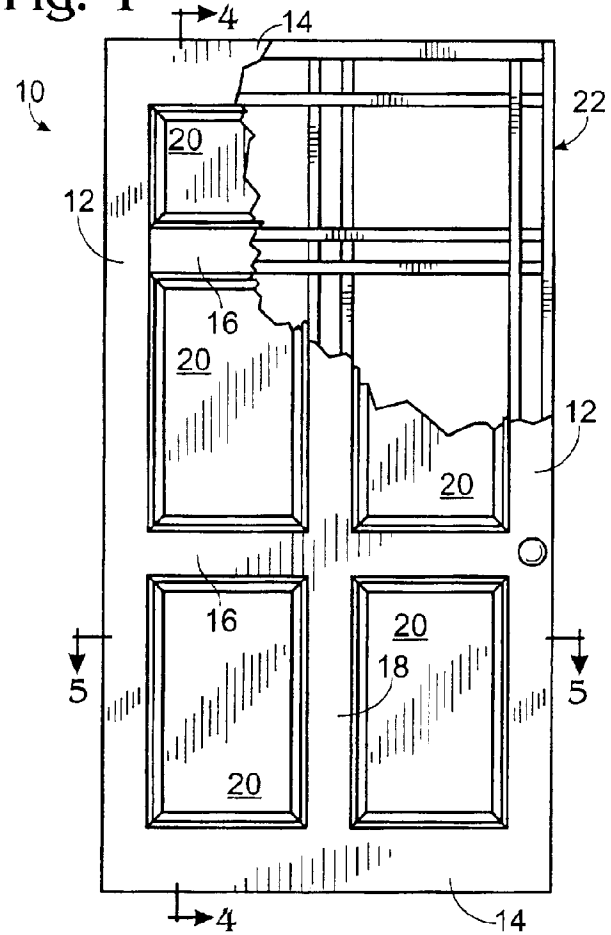
FIG. 1 is a partially cut away view of a decorative panel door according to the present invention.

The present invention is a decorative panel door having a box frame structure, generally indicated at 10. Turning to FIG. 1, door 10 includes edge stiles 12 extending vertically along the sides of door 10. A set of end rails 14 extends horizontally between the top and bottom ends of stiles 12. One or more intermediate rails 16 extends between inner portions of stiles 12. Similarly, one or more intermediate stiles 18 extends between rails 14 and 16. Panels 20 fill the open rectangular spaces formed between the stiles and rails of door 10. Stiles 12 and 18, rails 14 and 16, and panels 20 fit together to make a decorative panel door. As shown in the cut-away portion of FIG. 1, a lattice framework 22 supports door 10.

Figure 2:
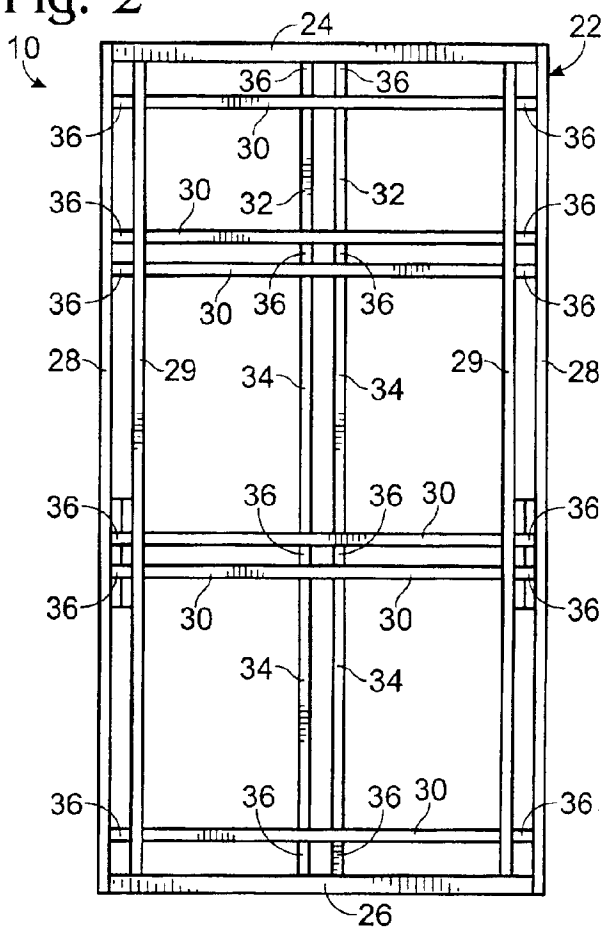
FIG. 2 is a view of a lattice frame for the decorative panel door of FIG. 1.

Turning to FIG. 2, lattice framework 22 of door 10 is shown in more detail. Framework 22 provides structural strength to door 10 and support for surface cover pieces, as will be explained below with reference to FIG. 3. Framework 22 includes a header 24 extending horizontally across the top of door 10. A corresponding footer 26 extends horizontally across the bottom of door 10. Header 24 and footer 26 form the top and bottom elements of framework 22.

Connecting header 24 and footer 26 along the vertical sides of framework 22 are edge-stile-frame-members 28. Each vertical edge stile 12 includes an outer edge-stile-frame member 28 ending vertically the length of the door and an inner edge-stile-frame-member 29 interconnecting header 24 with footer 26. The spacing between a pair of edge-stile-frame-members 28 and 29, which form a single edge stile 12, is determined by the desired width of the door stiles. Typically, edge-stile-frame-members 28 and 29 are made of lumber, or a laminated wood, such as plywood.

Framework 22 further includes intermediate-rail-frame-members 30, which interconnect inner edge-stile-frame-members 29. Intermediate-rail-frame-members 30 form a portion of framework 22, which supports horizontal rails 14 and 16.

Framework 22 also includes vertical intermediate-stile-frame-members 32 and 34. Intermediate-stile-frame-members 32 and 34 may be independent members mechanically fastened to intermediate-rail-frame-members 30 and work in tandem with spacer members 36. Members 32 are sized shorter in length for making a smaller set of panels 20 and members 34 are sized longer in length for making a longer set of panels 20. Spacer members 36 are used as spacers to support load between pairs of intermediate-rail-frame members 30. Spacer members 36 may also be used between header 24 or footer 26 and intermediate-rail-frame members 30. Spacer members 36 may also be used horizontally as spacers between adjacent edge-stile-frame members 28.

In an alternative embodiment, intermediate-stile-frame-members 32 and 34 are integral with spacer members 36 and form a single continuous member extending from header 24 to footer 26. In this embodiment, horizontal intermediate-rail-frame-members 30 and vertical intermediate-stile-frame-members 32 and 34 are notched out to interlock with one another. Therefore, in this embodiment members 32 and 34 are integral with spacer members 36 along the vertical and similarly, along the horizontal members 30 are integral with spacer members 36. It should be noted that all members of framework 22 are typically made of lumber. However, other suitable materials may be used to make framework 22 including but not limited to polymer materials, graphite materials, etc.

Figure 3:
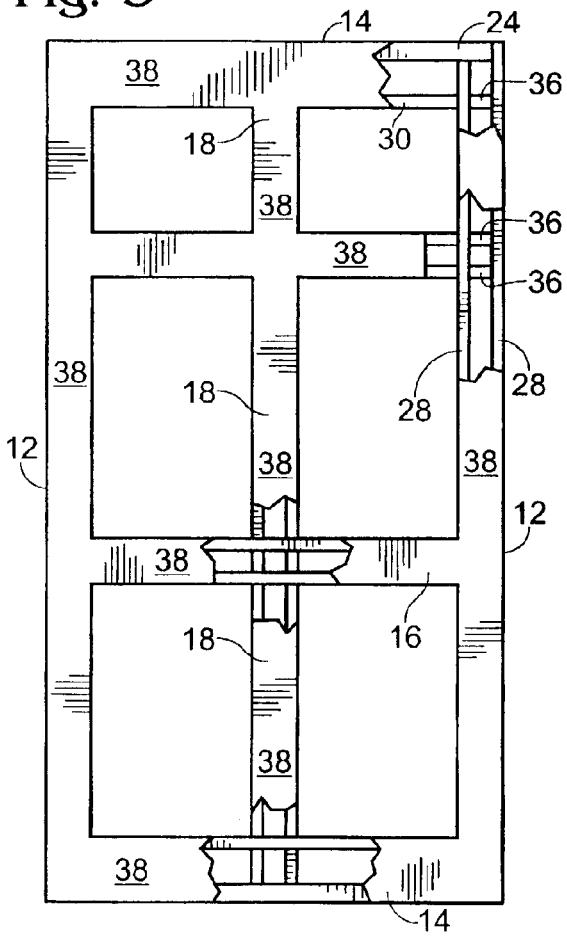
FIG. 3 is a partially cut away view of the decorative panel door of FIG. 1 with decorative panels removed, leaving the stiles and rails.

Turning to FIG. 3, surface 38 covers a portion of framework 22 attaching thereto, and forming the stiles 12 and rails 14 and 16 of door 10. Surface 38, for example may be a complete sheet of surface material having rectangular holes cut out where the panels may be inserted. As will be better illustrated with reference to FIG. 5, the addition of surface 38 on both the front side and back side of framework 22 forms a hollow-box-structure for stiles 12 and rails 14 and 16 such that hollow core voids exist between the frame members of the stiles and the rail members. Edge stiles 12 extend vertically along the length of door 10. Similarly, surface 38 forms top rails and bottom rails attach to framework 22, forming top and bottom door rails 14. Top and bottom door rails 14 extend between edge stiles 12. Similarly, surface 38 forms intermediate rails 16. Intermediate rails 16 extend horizontally between edge stiles 12. Vertical intermediate stile 18 may also be formed from surface 38. Intermediate stile 18 extends vertically, in the center of the door, between adjacent rails.

Figure 4:
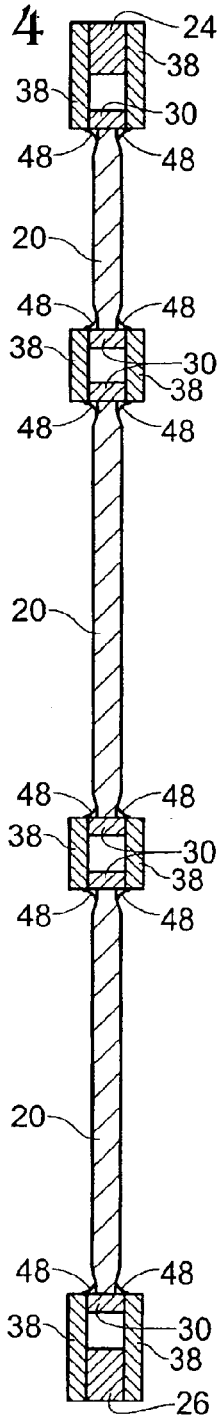
FIG. 4 is a sectional view of the door of FIG. 1 taken along line 4—4.
Figure 5:
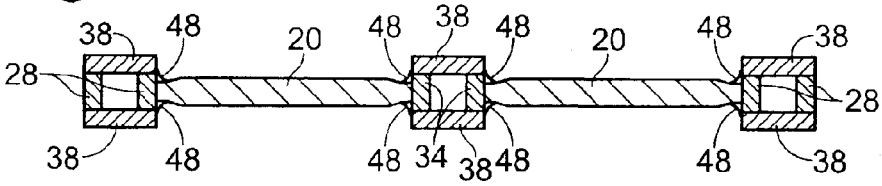
FIG. 5 is a sectional view of the door of FIG. 1 taken along line 5—5.

Turning to FIGS. 4 and 5, panels 20 of door 10 are positioned between the stiles and rails. Fastening strips of molding 48 around the edges of panels 20 along both the front and back secures panels 20 to door 10. Each opening between the rails and stiles of door 10 has a panel secured in place. Panels 20 are shown as solid pieces of decorative hard wood. However, it should be understood that panels 20 may be decorative glass, or any other decorative element capable of being held in place by molding strips 48. In FIG. 4, the hollow-box-structure of rails 14 and 16 are shown. Surface cover 38 forms the exposed surfaces of the rails' box structures, while members 30 form the internal members of the rails' box structure. Similarly, in FIG. 5, the hollow-box-structure of stiles 12 and 18 is shown. Cover 38 forms the front and rear exposed surfaces of the stiles' box structure, while internal member 34 forms the remainder of the stiles' box structure.

The hollow box structure of the sites and rails of door 10 creates a light weight dimensionally stable door structure. The use of a plywood material for form the members of framework 22 further increases the dimensional stability of the door structure without adding significant weight. As described above, decorative panel door 10 provides a stable panel door that resists sagging, warping and splitting. Decorative panel door 10 provides reduced weight and durability.

While the present invention has been particularly shown and described with reference to the foregoing preferred embodiments, those skilled in the art will understand that many variations may be made therein without departing from the spirit and scope of the invention. The description of the invention should be understood to include all novel and non-obvious combinations of elements described herein, and claims may be presented in this or a later application to any novel and non-obvious combination of these elements. Where the claims recite "a" or "a first" element or the equivalent thereof, such claims should be understood to include incorporation of one or more such elements, neither requiring nor excluding two or more such elements.

We claim:

1. A panel door comprising:

a hollow core framework configured to form a support structure for the panel door, wherein the framework includes:

a header and a footer extending substantially the entire width of the panel door;

a set of stile members extending between the header and footer forming an edge-stile frame, each stile member having an exterior-frame member and an interior-frame member;

a set of intermediate rail members extending horizontally between interior-frame members; and spacer members inserted between the exterior-frame members and the interior frame members at the intersections of the stile members and rail members, the spacer members being configured to space apart the respective frame members of the stile members and to space apart the respective rail members thereby forming hollow core voids between the respective rail members and the respective frame members of the stile members:

a pair of surface covers one for each side of the panel door configured to overlay the framework and be secured thereto to form both a set of stiles and a set of rails for the panel door, wherein the set of stiles includes at least one intermediate stile and wherein each surface cover is a one-piece sheet;

a set of open spaces bounded by the set of rails and the set of stiles; and a set of panels secured in the set of open spaces between the stiles and rails.

2. The panel door of claim 1, wherein the set of panels are secured in the set of open spaces between the stiles and rails by a plurality of independent strips of molding secured to the framework above and below each panel, around a circumference of each panel.

3. The panel door of claim 1, wherein the set of panels includes six panels.

4. The panel door of claim 3, wherein the set of panels includes four large panels and two small panels.

5. A panel door comprising:

a hollow core framework configured to form a support structure for the panel door, wherein the framework includes:

a header and a footer extending substantially the entire width of the panel door;

a set of stile members extending between the header and footer forming an edge-stile frame, each stile member having an exterior-frame member and an interior-frame member;

a set of intermediate rail members extending horizontally between interior-frame members; and spacer members inserted between the exterior-frame members and the interior frame members at the intersections of the stile members and rail members, the spacer members being configured to space apart the respective frame members of the stile members and to space apart the respective rail members thereby forming hollow core voids between the respective rail members and the respective frame members of the stile members;

a one-piece surface cover configured to overlay the framework to form a set of stills and rails for the panel door defining open spaces there between; and a set of panels secured in the spaces between the stiels and rails.

6. The panel door of claim 5, wherein the set of panels is held between the stiles and rails by a plurality of independent strips of molding attached around a circumference of each panel, above and below each panel.

7. The panel door of claim 5, wherein the set of panels includes six panels.

8. The panel door of claim 7, wherein the set of panels includes four large panels and two small panels.

* * * * *